United States Patent [19]

Kuhnel et al.

[11] Patent Number: 4,682,084

[45] Date of Patent: Jul. 21, 1987

[54] HIGH INTENSITY DISCHARGE LAMP SELF-ADJUSTING BALLAST SYSTEM SENSITIVE TO THE RADIANT ENERGY OR HEAT OF THE LAMP

[75] Inventors: Donald S. Kuhnel, Houston; Sidney A. Ottenstein, Spring, both of Tex.

[73] Assignee: Innovative Controls, Incorporated, Houston, Tex.

[21] Appl. No.: 770,663

[22] Filed: Aug. 28, 1985

[51] Int. Cl.[4] ..... G05F 1/00; H05B 37/02; H05B 37/04; H05B 41/36

[52] U.S. Cl. ..... 315/307; 315/291; 315/309; 315/158; 315/151; 323/277

[58] Field of Search ..... 315/307, 308, 309, DIG. 7, 315/158, 159, 151, 157, 155, 306, 291; 323/265, 277

[56] References Cited

U.S. PATENT DOCUMENTS

| | | | |
|---|---|---|---|
| RE 29498 | 12/77 | Meiattini | 195/103.5 |
| RE 30296 | 6/80 | Kirby | 307/252 |
| 3,222,572 | 12/1965 | Powell | 315/151 |
| 3,247,422 | 4/1966 | Schultz | 315/206 |
| 3,259,797 | 7/1966 | Heine | 315/174 |
| 3,265,930 | 8/1966 | Powell | 315/209 |
| 3,309,567 | 3/1967 | Flieder | 315/176 |
| 3,449,629 | 6/1969 | Wigert et al. | 315/308 |
| 3,486,070 | 12/1967 | Engel | 315/225 |
| 3,541,421 | 11/1970 | Buchman | 320/1 |
| 3,582,708 | 6/1971 | Snyder | 315/91 |
| 3,590,316 | 6/1971 | Engel et al. | 315/308 |
| 3,619,713 | 11/1971 | Biega | 315/105 |
| 3,659,146 | 4/1972 | Munson | 315/92 |
| 3,681,654 | 8/1972 | Quinn | 315/151 |
| 3,753,071 | 8/1971 | Engel | 315/2 |
| 3,754,160 | 8/1973 | Jensen | 315/97 |
| 3,870,943 | 3/1975 | Weischedel | 321/2 |
| 3,873,882 | 3/1975 | Gershen | 315/92 |
| 3,876,855 | 4/1975 | Hirasawa | 219/131 |
| 3,882,354 | 5/1975 | May | 315/101 |
| 3,886,045 | 5/1975 | Meiattini | 195/103.5 |
| 3,890,537 | 6/1975 | Park | 315/208 |
| 3,906,302 | 9/1975 | Wigjboom | 315/209 |
| 3,927,348 | 12/1975 | Zawakski | 315/88 |
| 3,927,349 | 12/1975 | Suhren | 315/205 |
| 3,944,876 | 3/1976 | Helmuth | 315/205 |
| 3,967,159 | 6/1976 | Dendy | 315/247 |
| 3,969,652 | 7/1976 | Herzog | 315/224 |
| 3,999,100 | 1/1977 | Dendy | 315/308 |
| 4,004,187 | 1/1977 | Walker | 315/205 |
| 4,004,188 | 1/1977 | Cooper | 315/158 |
| 4,016,451 | 4/1977 | Engel | 315/158 |
| 4,023,067 | 5/1977 | Zelina | 315/209 |
| 4,039,897 | 8/1977 | Dragoset | 315/205 |
| 4,042,856 | 8/1977 | Steigerwald | 315/246 |
| 4,051,413 | 9/1977 | Abadie | 315/219 |
| 4,060,751 | 11/1977 | Anderson | 315/209 |
| 4,060,752 | 11/1977 | Walker | 315/244 |
| 4,066,930 | 1/1978 | Summa | 315/209 |
| 4,074,170 | 2/1978 | Orban | 315/120 |
| 4,087,702 | 5/1978 | Kirby | 307/252 |
| 4,100,462 | 7/1978 | McLellan | 315/179 |
| 4,121,136 | 10/1978 | Fournier | 315/205 |
| 4,127,789 | 11/1978 | Anderson | 315/209 |
| 4,127,795 | 11/1978 | Knoll | 315/210 |
| 4,145,636 | 3/1979 | Doi | 315/101 |
| 4,151,445 | 4/1979 | Davenport | 315/92 |
| 4,156,166 | 5/79 | Shapiro | 315/209 |
| 4,163,923 | 8/79 | Herbers | 315/209 |
| 4,170,747 | 10/79 | Holmes | 315/307 |
| 4,199,710 | 4/80 | Knoll | 315/307 |
| 4,204,141 | 5/80 | Nuver | 315/205 |
| 4,210,846 | 7/80 | Capewell | 315/311 |
| 4,219,760 | 8/80 | Ferro | 315/121 |
| 4,232,252 | 11/80 | Peil | 315/248 |
| 4,234,823 | 11/80 | Charlot | 315/92 |
| 4,236,100 | 11/80 | Nuver | 315/224 |
| 4,236,101 | 11/80 | Luchaco | 315/158 |
| 4,237,403 | 12/80 | Davis | 315/98 |
| 4,241,295 | 12/80 | Williams | 315/294 |
| 4,245,177 | 1/81 | Schmitz | 315/205 |
| 4,251,752 | 2/81 | Stolz | 315/206 |
| 4,253,046 | 2/81 | Gerhard | 315/224 |
| 4,259,614 | 3/81 | Kohler | 315/219 |
| 4,277,728 | 7/81 | Stevens | 315/307 |
| 4,286,195 | 8/81 | Swines | 315/224 |
| 4,287,468 | 9/81 | Sherman | 315/322 |
| 4,316,127 | 2/82 | Lamoureux | 315/408 |
| 4,322,817 | 3/82 | Kuster | 363/26 |
| 4,323,824 | 4/82 | Roche | 315/289 |
| 4,346,331 | 8/82 | Hoge | 315/158 |
| 4,412,154 | 10/83 | Klien | 315/224 |
| 4,414,493 | 11/1983 | Henrich | 315/308 |
| 4,415,839 | 11/1983 | Lesea | 315/308 |
| 4,437,043 | 3/84 | Pitel | 315/308 |
| 4,464,606 | 8/1984 | Kane | 315/158 |
| 4,485,434 | 11/1984 | Beeston | 315/DIG. 7 |
| 4,498,031 | 2/85 | Stupp | 315/307 |
| 4,511,195 | 4/85 | Barter | 315/308 |
| 4,585,974 | 4/1986 | Stupp et al. | 315/DIG. 7 |

*Primary Examiner*—Saxfield Chatmon

*Attorney, Agent, or Firm*—Vaden, Eickenrohkt, Thompson & Boulware

[57] ABSTRACT

A self-adjusting ballast system for a high intensity discharge lamp. A lightweight, inexpensive and efficient ballast controls the strike and warmup stages of the high intensity discharge lamp, in particular high wattage lamps, through direct sensing of the radiant energy or heat output of the lamp itself. A current controller corrects for current imbalance in the alternating current lamp circuit due to bulb rectification or magnetic imbalance in the inverter transformer system.

6 Claims, 3 Drawing Figures

HIGH INTENSITY DISCHARGE LAMP SELF-ADJUSTING BALLAST SYSTEM SENSITIVE TO THE RADIANT ENERGY OR HEAT OF THE LAMP

FIELD OF THE INVENTIONS

This invention relates to the field of electronic solid state ballast systems for high intensity discharge lamps. More particularly this invention relates to the field of controlled systems for ballasting high intensity discharge lamps that efficiently and economically maintain an appropriate power level for the lamp during striking, warm-up and normal running.

BACKGROUND OF THE INVENTION

In high intensity discharge lamps, light is generated when an electric current is passed through a gaseous medium. The lamps have variable resistance characteristics that require operation in conjunction with a ballast to provide appropriate voltage and current limiting means. Control of the voltage, frequency and current supplied to the lamp is necessary for proper operation and determines the efficiency of the lamp. In particular it determines the size and weight of the required ballast.

The appropriate voltage, frequency and current for efficient running of a lamp in its normal operating state is not appropriate for the lamp during its warm-up stage. A high intensity discharge lamp typically takes several minutes to warm up from striking to its normal operating state. Initially the lamp is an open circuit. Short pulses of current are sufficient to strike the lamp provided they are of adequate voltage. Subsequent to striking, the lamp's resistance drops radically. The resistance then slowly rises during warm-up to its normal operating level. Hence, subsequent to striking and during warm-up the current of the lamp must be limited to prevent internal lamp damage.

A loss of power causes the lamp to extinguish. After a suitable cooling period the striking and warm-up phase must be repeated. The lamp's ballast system must detect and respond effectively and efficiently to the situation.

At times during warm-up high intensity discharge lamps exhibit "bulb rectification." For reasons not completely clear the lamp temporarily conducts in only one direction. A ballast system must achieve its objectives while accommodating this situation.

The prior art, as represented by U.S. Pat. Nos. 4,240,009, Paul, and 4,415,839, Lesea, regulate the current in the ballast system during the warm-up phase of a high intensity discharge lamp based on monitoring current and/or wattage consumption, or on monitoring power consumption alone. The prior art does not teach current regulation during warm-up based on monitoring the radiant energy, brightness, or the heat generated by the lamp itself.

Moreover, the prior art has not been able to produce a commercial feasible high power solid state ballast system for operation in, for example, high wattage mercury vapor lamps, that combines such features as low cost, light weight and inexpensive parts with efficiency and long life. The present invention overcomes these prior design limitations and presents a commercially feasible high power ballast (high wattage mercury vapor is the preferred embodiment) using precision control of current through relatively low power switches The present invention combines simplicity of design, light weight, small size and inexpensive parts with high efficiency and a probable longer bulb and ballast life due to the method of the controlled low current start up.

Therefore, it is a feature of the present invention to provide a self-adjusting ballast system for high intensity discharge lamps in an improved manner wherein precision control of the start up characteristics of the lamp is provided by means sensitive to the radiant energy or heat of the lamp.

It is another feature of the present invention to provide a self-adjusting ballast system for high intensity discharge lamps in an improved manner wherein, current imbalance in the alternating current lamp circuit is controlled by means of a current sensor in series with at least one switch.

It is another feature of the invention to provide a self-adjusting ballast system for high intensity discharge lamps in an improved manner wherein the system immediately resets itself to the initial strike state if the lamp extinguishes.

BRIEF DESCRIPTION OF THE DRAWINGS

So that the manner in which the above-recited features, advantages and objects of the invention, as well as others which will become apparent, are attained and can be understood in detail, more particular description briefly summarized above might be had by reference to the embodiment thereof which is illustrated in the drawings, which drawings form a part of the specification. It is to be noted, however, that the appended drawings illustrate only a typical embodiment of the invention and are therefore not to be considered limiting of its scope as the invention may admit to other equally effective embodiments.

DESCRIPTION OF THE PREFERRED EMBODIMENT

Figure 1:
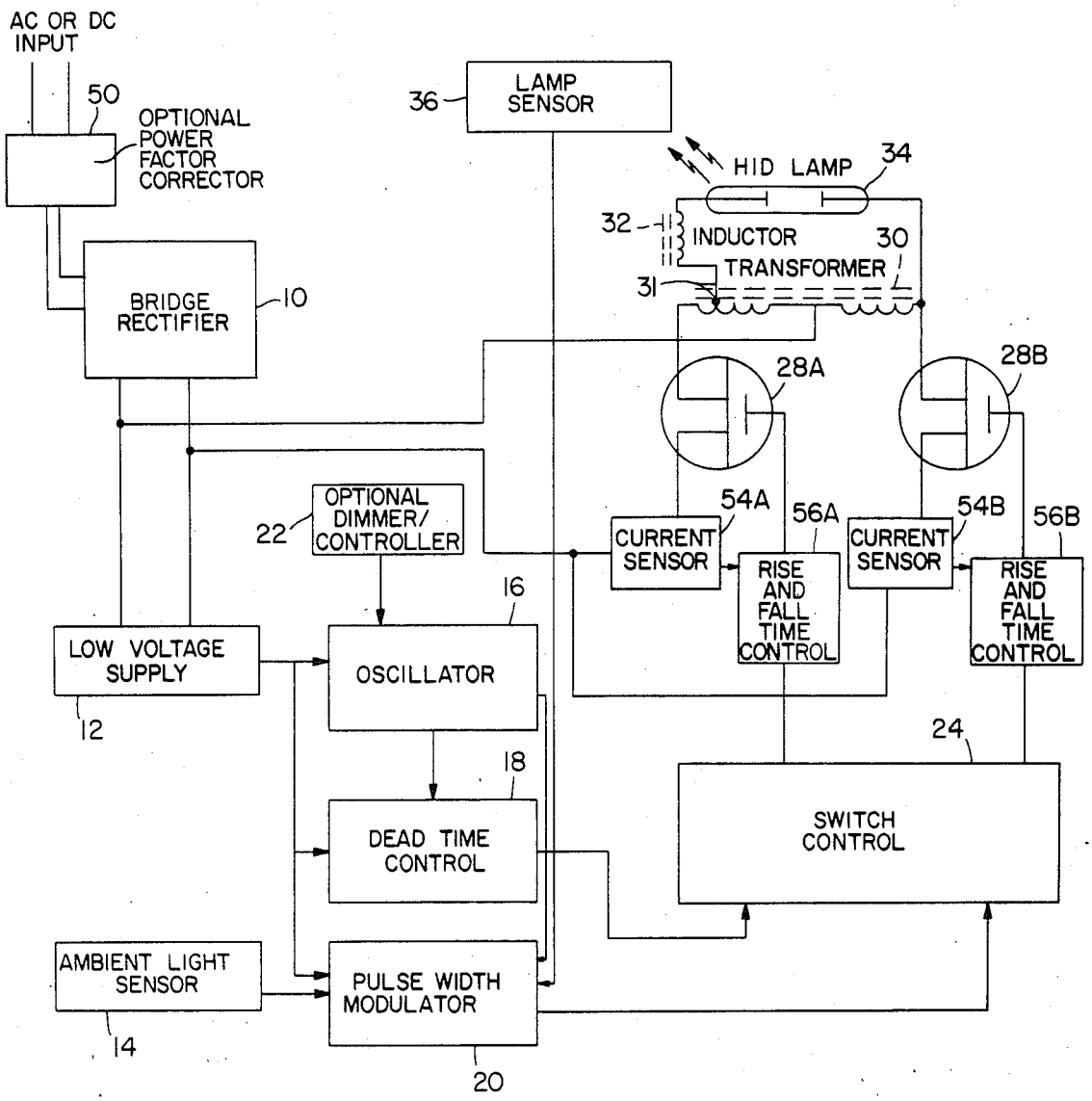
FIG. 1 is a block diagram illustrating the control schematic of a preferred embodiment of the self-adjusting ballast system.

FIG. 1 illustrates in a schematic block diagram fashion the elements of a preferred embodiment of the self-adjusting ballast system utilizing an inverter with two switches, an autotransformer and a lamp circuit that has an inductor in series with the lamp as a current limiting means.

The scheme assumes an input of either alternating current or direct current. If the input is alternating, AC to DC converter 10 rectifies in a traditional fashion the alternating wave into direct current waves. Optional power factor corrector 50 may be added to input alternating current lines for line power factor correction. Connecting the DC power line through converter 10 yields a safety feature. The lines of the ballast system can not be connected incorrectly to a DC power source.

Low voltage supply 12, fed by input from converter 10, supplies low voltage direct current to an oscillator, a dead time controller and a pulse width modulator. The oscillator, dead time controller and pulse/width modulator together with the lamp sensors and the switch control forms the switch driving means.

Oscillator 16 generates a high frequency signal, high at least in relation to the line frequency. As an option, to vary the power output to the lamp, the frequency of oscillator 16 may be varied by dimmer 22. Dimmer 22 in addition to being a manually set dimming device, could be a lamp operation controller set by a photo sensitive device observing the lamp to run the lamp at constant intensity, set by a photo sensitive device observing illuminated areas to maintain constant illumination, or set by a lamp circuit voltage sensor which together with current control sensors 54A and 54B could adjust the lamp for constant power consumption.

The high frequency wave formed by oscillator 16 is supplied to dead time controller 18 and pulse width modulator 20. Pulse width modulator 20 is also supplied with input from lamp sensor 36 and ambient light sensor 14.

The output from ambient light sensor 14 acts as an off and on switch, either not affecting the output of pulse width modulator 20, when the ambient environment is dark, or completely turning pulse width modulator 20 to an "off" state, when the ambient environment is light.

Assume the output of pulse width modulator 20 is not turned "off" by the ambient light sensor. Pulse width modulator 20 responds to the input from lamp sensor 36 and produces a modulated output signal which is a function of the radiant energy or heat measured by lamp sensor 36. The degree of modulation is inversely proportional to the sensed radiant energy or heat. Dead time controller 18 produces a modulated output signal to correspond to a maximum duty cycle of slightly less than one hundred percent. Such dead time controller provides a safety period to insure that switch controller 24 can not gate switches 28A and 28B on at the same time. As a result of dead time controller 18, switch control 24 must gate both switches 28A and 28B off for a minimum dead time each oscillating signal cycle.

When the lamp is first struck or turned on, the lamp puts out very little radiant energy or heat, as detected by the lamp sensor. At this stage, which is the beginning of the warm-up cycle, the pulse width modulator severly restricts current through the lamp circuit. Each switch is gated on only a small fraction of each duty cycle. At the beginning of the warm-up cycle the lamp's resistance is very low. As the lamp begins to warm up, both its resistance and its radiant energy or heat output increases. The light sensor, detecting increased radiant energy or heat output, communicates with the pulse width modulator which in turn permits each switch to be gated on for a larger percent of each duty cycle. Current is gradually and precisely increased in correlation to the lamp's actual output yielding such a precise control of current during warm-up that both bulb and ballast life should increase. When the lamp is completely warmed up the circuit will operate in what constitutes the normal operating mode. Each switch remains gated on for its maximum designed duty cycle.

If power should fail, even momentarily, the lamp will extinguish. Lamp sensor 36 detects the change in output of radiant energy or heat from the lamp and resets the ballast system automatically for the minimal current start-up and warm-up stage. Current is quickly cut back from the lamp (although the lamp will not be able to strike until it cools, a process that can take several minutes).

Switch control 24 combines the outputs of dead time controller 18 and pulse width modulator 20 and sends the wave form alternately to gate on switch 28A or switch 28B. Rise and fall time controls 56A and 56B achieve a slow on/fast off of the gates of switches 28A and 28B to improve magnetic characteristics. Current sensors 54A and 54B in series with switches 28A and 28B automatically gate off each switch for that half cycle of the oscillator signal cycle when the switch current exceeds a certain safe value. The switch current may become excessive because of "bulb rectification" or exhibit imbalance because of lack of perfect magnetic symmetry in the transformer.

Switches 28A and 28B determine which primary of autotransformer 30 is being energized. An induced current of different voltage and of the same frequency is induced in the secondary of transformer 30 and thus in the circuit containing lamp 34 and current limiting inductor 32. The duty cycle for each half wave of the induced current in the lamp circuit is a function of the on and off times of switches 28A and 28B, which in turn is a function of the dead time controller 18 and pulse width modulator 20 of the switch driving means.

The frequency of oscillator 16 determines the frequency of the alternating current in the lamp circuit. The frequency of oscillator 16 and the voltage transformation performed by transformer 30 and tap 31 are chosen to permit the selection of an efficient economical current limiting means, such as inductor 32, for the normal operating state for a given type and wattage of lamp.

Figure 2:
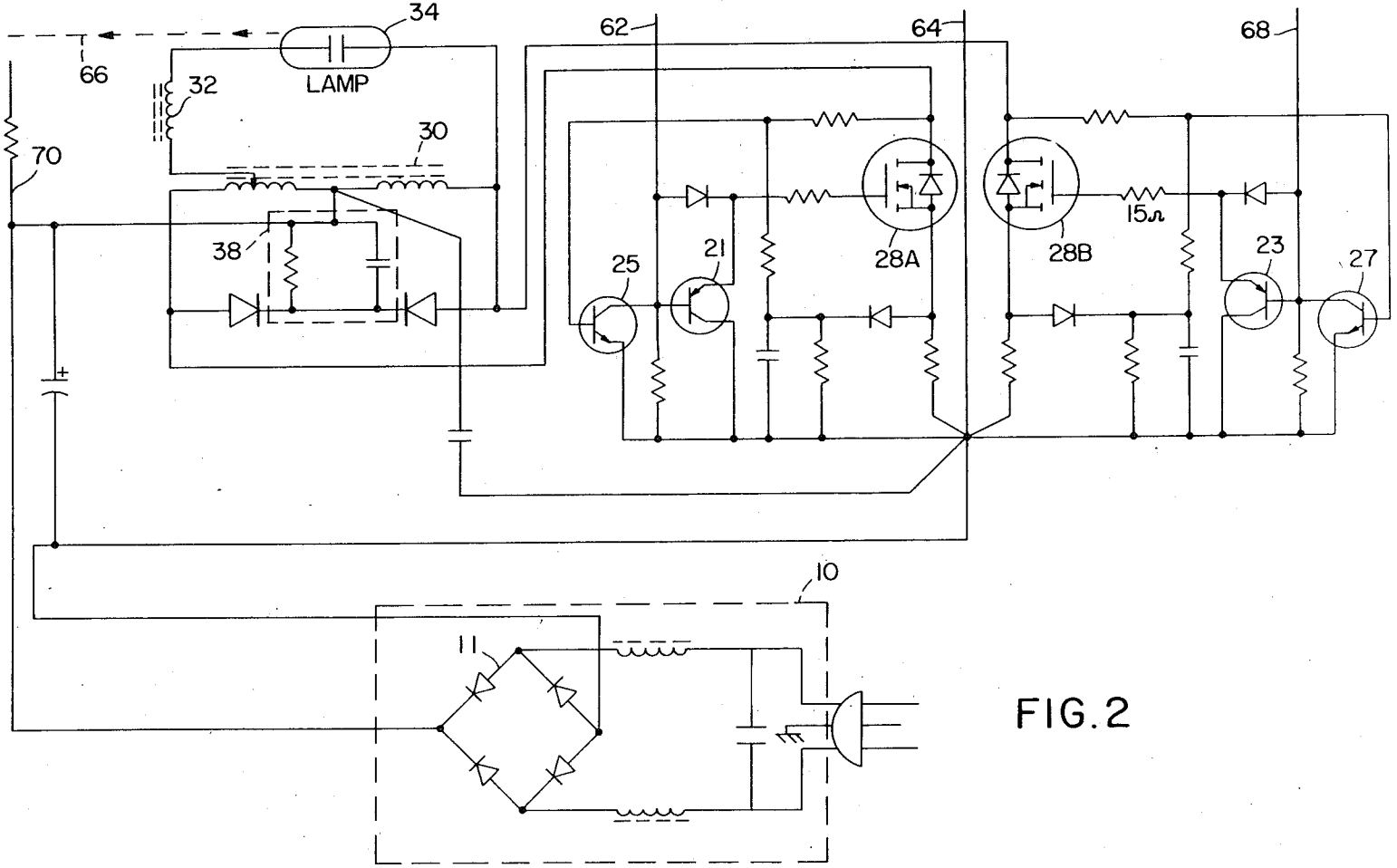
FIG. 2 and FIG. 3 are circuit diagrams of the above preferred embodiment of the invention.
Figure 3:
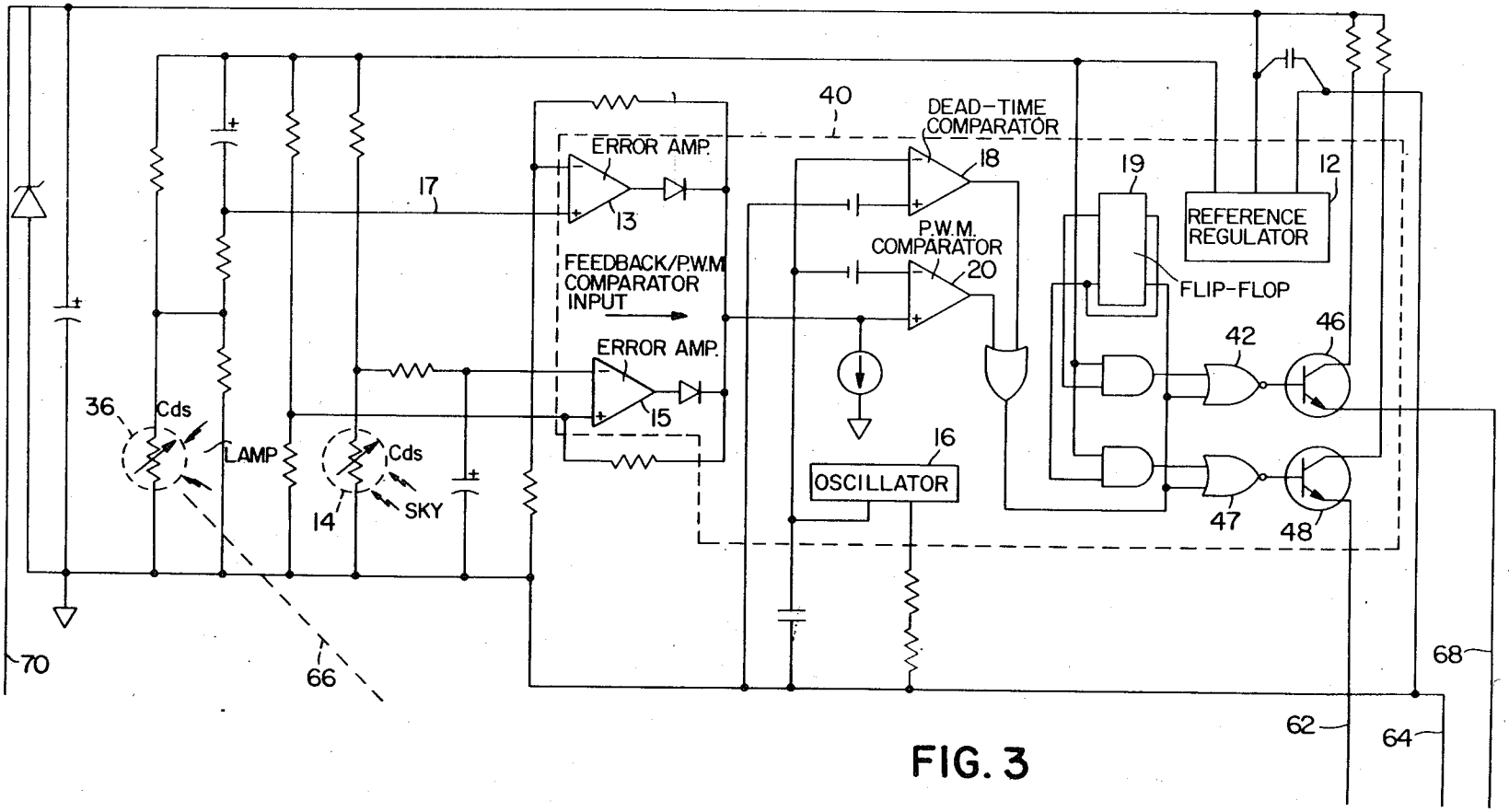

FIG. 2 and FIG. 3 represent a more specific circuit diagram for the preferred embodiment of the self-adjusting ballast system illustrated in FIG. 1. The embodiment illustrated in FIG. 3 utilizes a pulse width modulating subcircuit, 40, that is commercially available. Use of such circuit is convenient but not necessary.

In FIG. 2, it can be seen that AC to DC converter 10 consists of diode bridge rectifier 11. Snubber circuit 38 is provided to accommodate surges in voltage in the primary transformer circuit due to the rapidly alternating current.

Referring to both FIG. 2 and FIG. 3, error amplifier 13 amplifies the input of line 17 which contains the output of a voltage divider incorporating lamp sensor 36. Error amplifier 15 operates as a Schmitt trigger and performs the function of an on/off switch. Its output voltage is a function of the input from a voltage divider containing ambient light sensor 14. Error amplifier 15 either turns pulse width modulator comparator 20 to a continuous "off" state or does not effect the output of pulse width modulator comparator 20 at all.

Pulse width modulator comparator 20 when not turned to an "off" state by error amplifier 15, compares the input signal voltage from error amplifier 13, an amplified input from lamp sensor 36, with the variable periodic signal voltage generated by oscillator 16. During that part of the oscillator signal cycle that the variable periodic signal voltage is greater than the signal voltage supplied by error amplifier 13, pulse width modulator comparator 20 is turned to an "on" state.

Dead time comparator 18 compares the variable periodic signal voltage from oscillator 16 each cycle with a minimal set control level voltage and is turned to an "on" state for all but a small percentage of each signal cycle of oscillator 16. The logic of the pulse width modulator subcircuit 40 combines the output of dead time comparator 18 with the output of pulse width modulator comparator 20 and permits NOR gates 42 and 44 to enable transistor switches 46 and 48 only when both comparators are turned in the "on" state.

Dead time comparator 18 generates the clock signal for flip flop 19, corresponding to the frequency of oscillator 16, so that output switch transistors 46 and 48 may be driven alternately through control of the flip flop by NOR gates 42 and 44. The output of the switch driver means are two pulse width modulated signals, at the frequency of oscillator 16, which open and close switches 28A and 28B.

Reference regulator 12 generates a low voltage supply necessary to run the sensing electronics. Switches 21 and 23 serve to provide a slow on/fast off switching scheme for power switches 28A and 28B. Switches 25 and 27 provide current sensing and control of the current passing through switches 28A and 28B.

The preferred embodiment illustrates only one arrangement of switches and transformer that achieves the purposes of an inverter in changing direct current of one voltage to high frequency alternating current of a different or the same voltage. Those skilled in the art will recognize that a variety of configurations of switches and transformers, or power converters, will achieve the equivalent result. Some such configurations might be a full bridge power converter, a fly-back power converter with optional clamp windings, a half-bridge power converter with split windings, a half-bridge power converter or a forward power converter.

The means to sense the lamp's emitted radiant energy or heat might be any number of photo sensitive or thermistor devices. The preferred embodiment utilizes a cadmium sulfide cell.

While a particular embodiment of the invention has been shown and described, it will be understood that the invention is not limited thereto since many modifications may be made and will become apparent to one skilled in the art.

I claim:

1. A self-adjusting ballast system for mercury vapor, high intensity discharge lamps having outputs of 100 watts or greater, comprising:

a direct current source;

a lamp circuit containing a high intensity discharge lamp;

sensing means for sensing the radiant energy output of said lamp;

a pulse width modulator which, in response to the output of said sensing means, varies the width of the pulses that power said lamp during warm-up of said lamp;

a high frequency oscillator;

a DC to AC converter that converts current from said direct source to pulses of alternating current for powering said lamp, said converter comprising:

at least one switch for gating current to said lamp;

a switch control means, responsive to said high frequency oscillator, for controlling said switch and thereby controlling the frequency of the alternating current pulses that power said lamp;

current sensing means for sensing the current being supplied to said lamp; and current control means for limiting the current through said lamp to a predetermined safe level when the current sensed by said current sensing means exceeds a reference value.

2. A self-adjusting ballast system for mercury vapor, high intensity discharge lamps having output of 100 watts or greater, comprising:

a direct current source;

a lamp circuit containing a high intensity discharge lamp;

sensing means for sensing the heat output of said lamp;

a pulse width modulator which, in response to the output of said sensing means, varies the width of the pulses that power said lamp during warm-up of said lamp;

a high frequency oscillator;

a DC to AC converter that converts current from said direct current source to pulses if alternating current for powering said lamp, said converter comprising:

at least one switch for gating current to said lamp;

a switch control means, responsive to said high frequency oscillator, for controlling said switch and thereby controlling the frequency of the alternating current pulses that power said lamp;

current sensing means for sensing the current being supplied to said lamp; and current control means for limiting the current through said lamp to a predetermined safe level when the current sensed by said current sensing means exceeds a reference value.

3. The apparatus of claims 1 or 2, further comprising:

a dead time controller whose output signal causes said pulse width modulator to vary the width of the pulses that power said lamp by a predetermined value.

4. The apparatus of claims 1 or 2, further comprising:

means for sensing the ambient light surrounding said lamp and for causing said converter to supply current to said lamp circuit only when the sensed ambient light is below a preset value.

5. The apparatus of claims 1 or 2 wherein said direct current source comprises:

an alternating currewnt source of approximately 110 volts; and a full wave bridge rectifier.

6. The apparatus of claims 1 or 2, wherein said current control means limits the current through said lamp to a predetermined safe level by removing gate drive from said switch for a predetermined period of time.

* * * * *

UNITED STATES PATENT AND TRADEMARK OFFICE

CERTIFICATE OF CORRECTION

PATENT NO. : 4,682,084

DATED : July 21, 1987

INVENTOR(S) : Donald S. Kuhnel et al

It is certified that error appears in the above-identified patent and that said Letters Patent is hereby corrected as shown below:

Column 6, line 49, "curewnt" should read -- current --.

Signed and Sealed this

Eighth Day of December, 1987

*Attest:*

DONALD J. QUIGG

*Attesting Officer*

*Commissioner of Patents and Trademarks*